United States Patent [19]

Morrow, Sr. et al.

[11] 4,013,174

[45] * Mar. 22, 1977

[54] SWING DRIVE WITH AUTOMATIC SHUT-DOWN CONTROL

[75] Inventors: James G. Morrow, Sr.; David J. Pech, both of Manitowoc, Wis.

[73] Assignee: The Manitowoc Company, Inc., Manitowoc, Wis.

[ * ] Notice: The portion of the term of this patent subsequent to Apr. 13, 1993, has been disclaimed.

[22] Filed: Oct. 22, 1975

[21] Appl. No.: 624,765

Related U.S. Application Data

[63] Continuation-in-part of Ser. No. 522,787, Nov. 11, 1974, Pat. No. 3,949,881.

[52] U.S. Cl. ..... 212/68; 60/468; 60/484; 74/409; 92/130 C; 214/138 C

[51] Int. Cl.[2] ..... B66C 23/86

[58] Field of Search ..... 212/66, 67, 68, 69, 212/66.69; 74/409; 214/132, 133, 134, 137, 138 R, 138 C, 132–134, 137–138 C; 92/130 C; 60/468, 484, 494

[56] References Cited

UNITED STATES PATENTS

| | | | |
|---|---|---|---|
| 1,829,807 | 11/1931 | McMurrin | 92/130 C X |
| 2,983,226 | 5/1961 | Livermore | 60/468 X |
| 3,949,881 | 4/1976 | Morrow | 74/409 X |

*Primary Examiner*—Robert J. Spar
*Assistant Examiner*—George F. Abraham
*Attorney, Agent, or Firm*—Leydig, Voit, Osann, Mayer & Holt, Ltd.

[57] ABSTRACT

A load handling device is disclosed having an improved swing drive assembly including a hydraulically driven pivotally mounted swing drive pinion biased against a segmented ring gear by a hydraulic actuator with a guide roller adjacent the pinion engaging a guide flange concentric with the ring gear to limit the maximum tooth engagement between the pinion and ring gear and thereby provide essentially constant backlash on the pinion gear regardless of eccentricities or other irregularities in the ring gear during swing drive operation. When the swing drive pump is shut down a bypass valve is automatically actuated shunting the flow of hydraulic fluid around the pump and a spring operates to counteract the separating force between the pinion and ring gear due to wind induced rotating force which produces torque on the pinion as a result of the back pressure in the motor and the shunted supply-return lines.

5 Claims, 8 Drawing Figures

SWING DRIVE WITH AUTOMATIC SHUT-DOWN CONTROL

This is a continuation-in-part of application Ser. No. 522,787, filed Nov. 11, 1974, now U.S. Pat. No. 3,949,881.

The present invention relates generally to load handling devices and more particularly concerns an improved swing drive assembly for large load handling cranes and the like.

It is known in the art, that the lifting capacity of a load handling device, can be increased by providing the device with a large diameter roller path for supporting on rollers an opposed boom and a counterweight. One example of such a device is shown in U.S. Pat. No. 3,485,383. Such arrangements have afforded marked increases in the lifting capacities of the basic unit and have been quite satisfactory for many heavy duty lifting operations.

However, where the duty cycle for the device involves both lifting and swinging heavy loads, great stress is imposed on the normal swing drive gears of such devices. This, of course, leads to rapid wear of conventional swing drive pinions and ultimate failure, particularly where repeated swings are made under heavy load. While attempts have been made in the past to provide outboard, peripheral swing drive arrangements, these have not proved altogether satisfactory, due largely to eccentricities and other irregularities in the outer ring gear, leading to widely varying backlash on the driving pinion. Although, presumably this problem could be overcome by precision fabrication of the outer ring gear to insure concentricity of the ring and uniformity of teeth formation within close tolerances, even with todays' technology, this would be nearly prohibitively expensive.

Accordingly, it is the primary aim of the present invention to provide an improved swing drive assembly for heavy load handling devices which does not require machining large ring gear components to close tolerances.

It is a further object to provide such an improved swing drive assembly which is designed to provide substantially constant backlash on the swing drive pinion thus reducing stresses and prolonging swing gear life.

A more detailed object is to provide a swing drive assembly of the above type which includes hydraulic actuated means for maintaining the extent of tooth engagement between the driving pinion and the stationary ring gear uniform and constant regardless of eccentricities or other irregularities therein during swing drive operation.

It is also an object of the invention to provide for automatically shunting fluid around the swing drive pump when it is shut down and thus reduce the back pressure generated by the swing drive motor due to wind induced rotation of the load handling device.

A still further detailed object of the invention is to provide an improved swing drive arrangement of the above type wherein a spring operates to counteract the separating force between the pinion and ring gear due to wind induced rotation.

Other objects and advantages of the invention will become apparent upon reading the following detailed description and upon reference to the drawings, in which.

Figure 3:
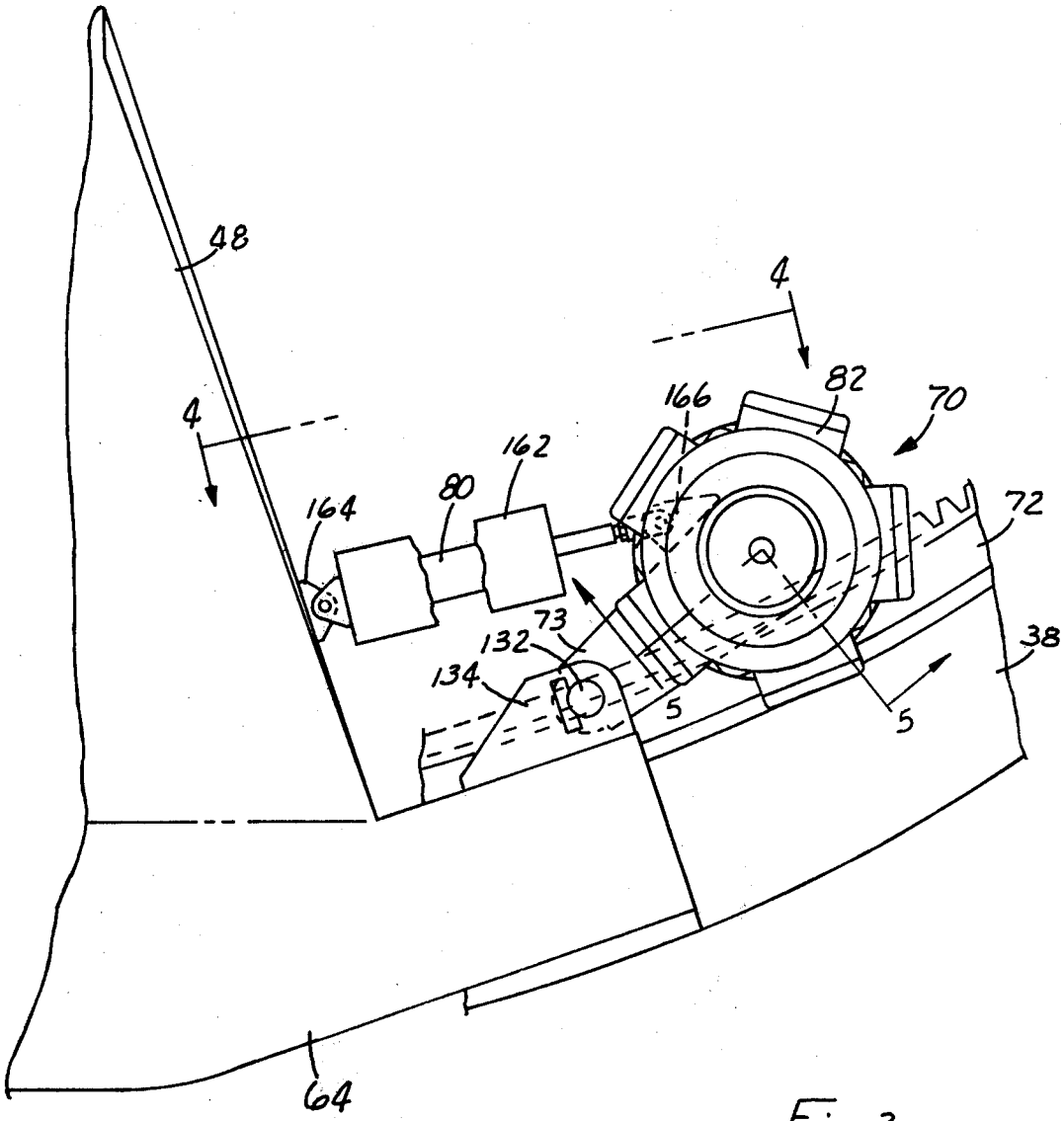
FIG. 3 is a further enlarged fragmentary plan view, showing, one of the swing drive assemblies of the present invention.
Figure 4:
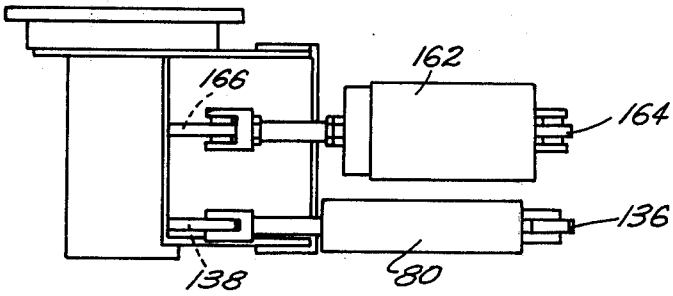
Figure 5:
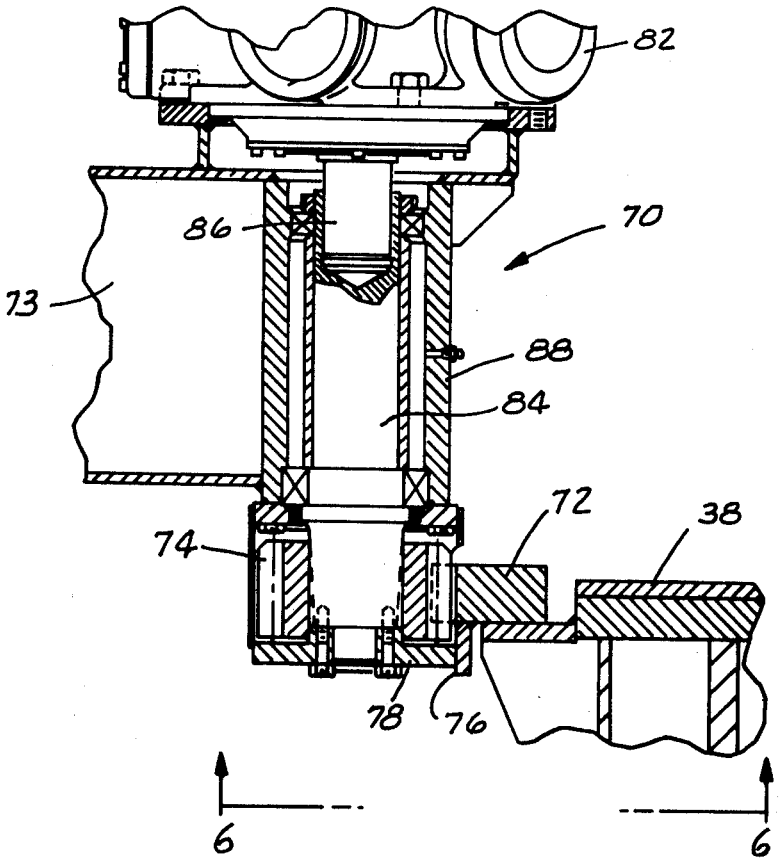
Figure 6:
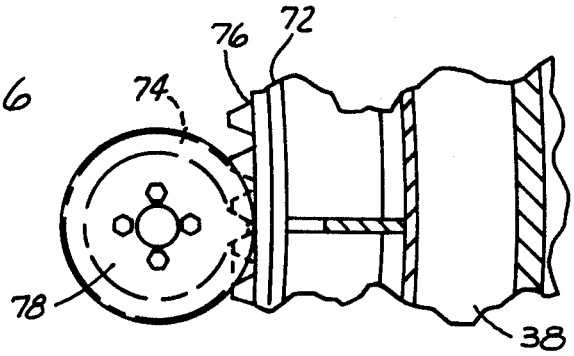
Figure 7:
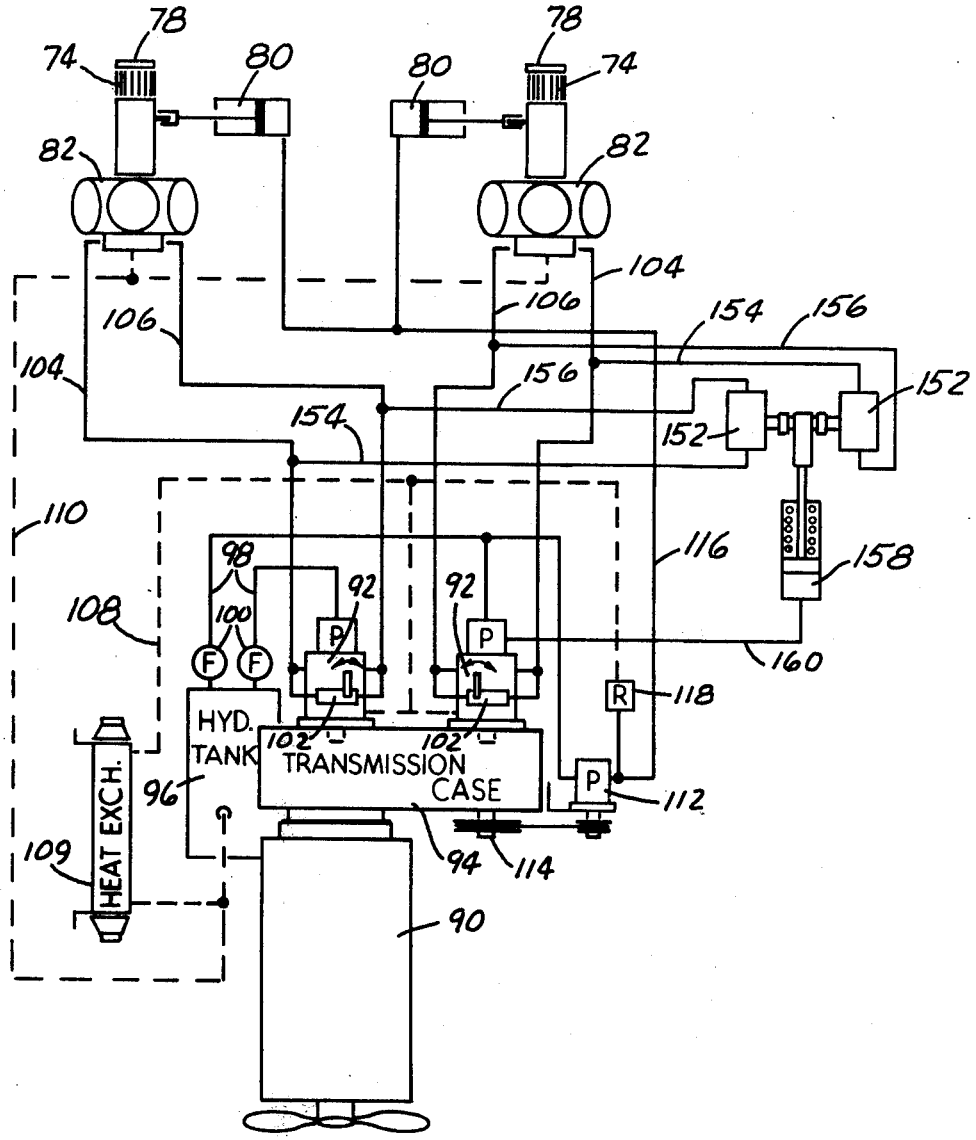
Figure 8:
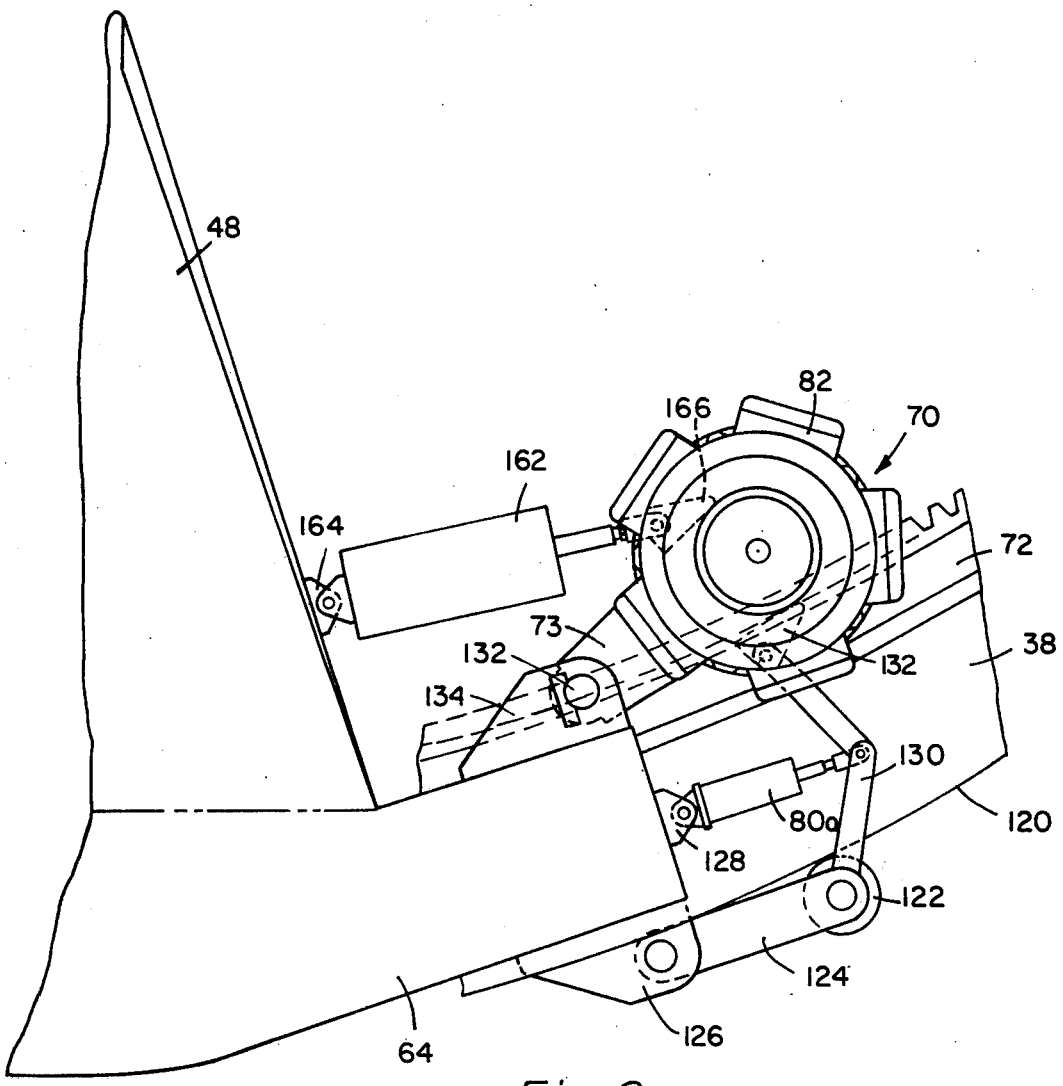

FIGS. 4 and 5 are enlarged partial sections taken substantially in the planes of lines 4—4 and 5—5, respectively, in FIG. 3;

FIG. 6 is a section taken substantially in the plane of line 6—6 in FIG. 5;

FIG. 7 is a schematic diagram of the hydraulic circuit for the swing drive assembly of the present invention; and, FIG. 8 is another embodiment of the means for maintaining substantially constant backlash in the swing drive pinion of the present invention.

While the invention will be described in connection with certain preferred embodiments, it will be understood that we do not intend to limit the invention to those embodiments. On the contrary, we intend to cover all alternatives, modifications and equivalents as may be included within the spirit and scope of the invention as defined by the appended claims.

Figure 1:
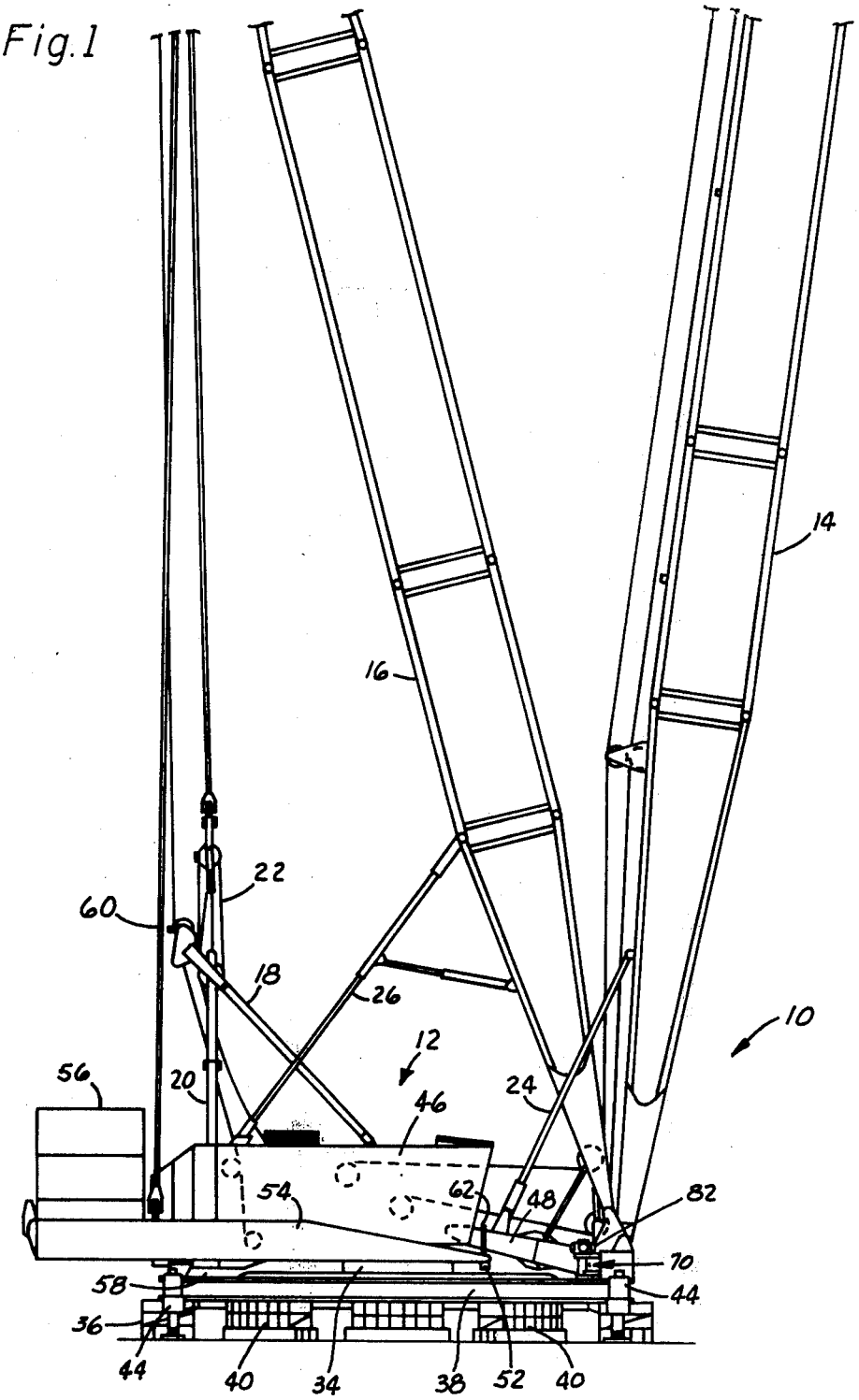
FIG. 1 is a fragmentary side elevation of a load handling device, in the form of a crane, with which the present invention is particularly associated.

Turning now to the drawings, there is shown in FIG. 1, a load handling device in the form of a large crane assembly, 10, with which the present invention is associated. The illustrated crane assembly 10 includes upper works 12 which carries a boom 14, mast 16, gantry 18, backhitch 20 and boom hoist rigging 22. Preferably, cushioned stops 24 and 26 are provided for the boom 14 and mast 16.

Figure 2:
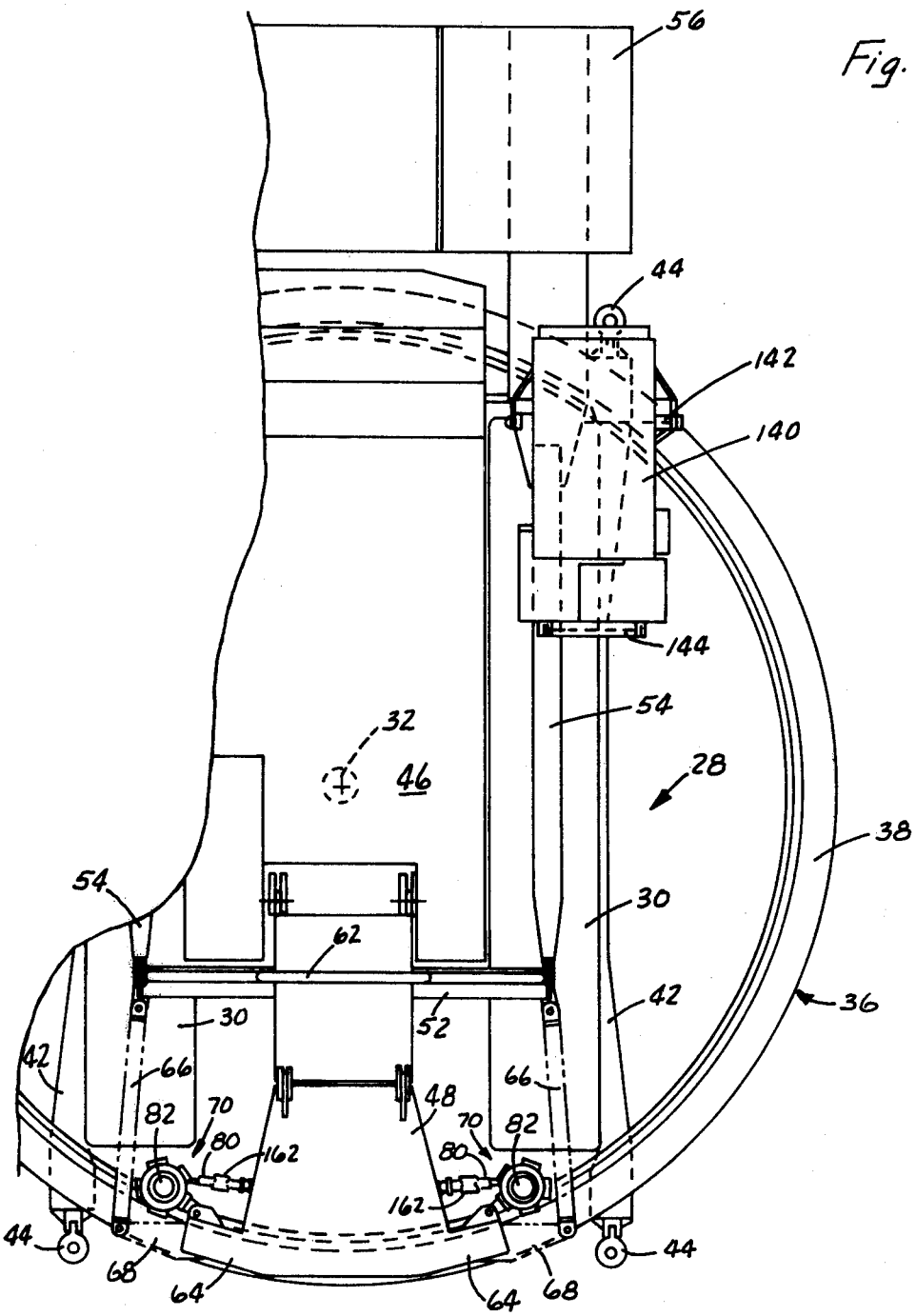
FIG. 2 is an enlarged fragmentary plan view of the crane in FIG. 1 showing a portion of the ring gear and roller path on which the crane is mounted.

As shown in FIG. 2, the basic unit of the illustrated crane assembly 10 is of the self-propelled type including lower works 28 normally supported by a pair of crawler track assemblies 30. It will be appreciated as the description proceeds, however, that the basic crane assembly could be normally supported by other types of self-propelled lower works or, indeed, it could be of a stationary nature. In either case, the lower works 28 are provided with a central pivot post 32 about which the upper works 12 rotates. When a self-propelled unit is utilized, as in the illustrated embodiment, the lower works 28 are further provided with a ring gear and roller path assembly 34 (see FIG. 1) for normally supporting the upper works 12 during mobile operation.

The crane assembly 10 also includes an annular ring support structure 36, as shown in FIGS. 1 and 2, of the general type disclosed in U.S. Pat. No. 3,485,383. Basically, this ring support 36 includes a reinforced roller path 38 supported above the ground on blocks 40 or the like. The lower works also include a pair of laterally spaced supporting frames 42 which span the roller path 38 and which are rigidly secured thereto. In the illustrated embodiment, one of the frames 42 is mounted on the outside of each of the track assemblies 30 and carries a jack 44 at each end. Thus, the crane lower works 28 is tied rigidly to the ring support structure, while the upper works 12 is rotatable about the central pivot post 32. (see FIG. 2)

The upper works 12 also includes a central machinery section 46 housing a power source and the principal winch drums for the load hoist and boom hoist lines. Extending forwardly from the central machinery section 46 and pivotally secured thereto is a boom support 48, the outer end of which overlies and is supported by front rollers (not shown) on the roller path 38. The boom 14 is pivotally mounted on the upper side of the support 48 above the front rollers. Intermediate the ends of the boom support 48 is a cross beam 52 to which a rearwardly extending counterweight support beam 54 is pivotally mounted adjacent each end. A large counterweight 56 is carried by the beams 54 which, in turn, are normally supported on the roller path 38 by rear roller assemblies 58. The supporting beams 54 and counterweight are also suspended from the mast 16 by counterweight supporting pendants 60 when a heavy load is suspended from the boom 14.

Though differing somewhat in detail, the boom 14, boom support 48, central machinery section 46, counterweight 56 and counterweight supporting beams 54 follow the teaching disclosed, in U.S. Pat. No. 3,485,383. To provide additional strength to the cross beam 52, its ends may be supported by a truss frame 62 which bridges the rear end of the boom support 48.

Referring more particularly to FIG. 2, the forward end of the boom support includes a pair of laterally extending wings 64 which are generally box shaped in cross-section and which preferably house the front supporting rollers (not shown). In addition, to provide increased rigidity to the upper works 12, particularly for resisting twisting movements between the counterweight 56, supporting beams 54 and the boom support 48 during swinging of heavy loads, a pair of optional struts 66 may be connected to the ends of the cross beam 52 and ears 68 rigidly connected to the wing portions 64 of the boom support 48. (see FIG. 2)

For rotating the upper works 12 relative to the ring support structure 36 and rigid lower works 28, an improved swing drive assembly 70 is provided. In the preferred embodiment, an internally toothed ring gear 72 is rigidly secured on the inner periphery of the roller path 38 and the boom support 48, which acts as a frame element, carries a pivotal link 73 which supports a drive pinion 74 journalled for engagement with the ring gear 72. (see FIGS. 5 and 6) Concentric with the ring gear 72, a guide flange 76 is mounted on the inner periphery of the roller path 38 and a guide roller 78 is mounted concentric with the pinion 74.

Hydraulic actuator means 80 are provided for urging the pinion 74 into engagement with the ring gear 72 and the guide roller 78 into engagement with the guide flange 76 during normal swing operation. By properly dimensioning the diameter of the guide roller 78 relative to the depth of the teeth on the pinion 74 and ring gear 72 the extent of engagement of the respective teeth can be regulated so as to maintain the backlash on the pinion 74 substantially constant regardless of eccentricities or other irregularities in the formation of the ring gear 72.

Because of the foregoing, the roller path 38 and the ring gear 72 may be formed of a plurality of arcuate segments bolted or otherwise rigidly secured together at the job site. Likewise, the guide flange 76 may also be formed in arcuate segments, but, preferably, it is rigidly and accurately secured to its companion ring gear segment such as by welding.

It will also be understood that since the guide roller 78 maintains the engagement of the teeth on the pinion 74 and ring gear 72 substantially constant, precision machining of the ring gear teeth to close tolerances is not essential. Rather, the ring gear teeth may be cut with reasonable accuracy even by current flame-torch cutting techniques. Moreover, while the ring gear 72 and guide flange 76 are shown in the illustrated embodiment secured to the inner periphery of the roller path 38, it should be appreciated that they could be secured to the outer periphery. In that case, of course, the pinion 74 and guide roller 78 would likewise be mounted outboard of the roller path 38 and would be urged inwardly into respective engagement with the ring gear 72 and guide flange 76.

For driving each of the pinions 74 a reversible hydraulic motor 82 is supported by the links 73 and a pinion drive shaft 84 is splined to the output shaft 86 of the motor 82. The shaft 84 is journalled in bearings mounted in a housing 88 at the free end of the link 73, (see FIG. 5). Referring now to FIG. 7, there is shown a schematic diagram of the power source and hydraulic circuit for driving the swing drive motors 82. The power source preferably includes an internal combination engine 90 which drives a pair of variable displacement, reversible output pumps 92 through a transmission case 94.

Hydraulic fluid is drawn by the pumps 92 from a tank 96 through supply lines 98 each having a filter 100 therein. Each of the pumps 92 has a control 102 for regulating the pump displacement and the direction of discharge through reversible supply/return lines 104, 106 coupled to each of the motors 82. The casing of each of the pumps 92 also drains to a sump line 108 connected to the tank 96 and has a heat exchanger 109 therein. A return line 110 is also provided to drain oil leakage from the casings of the motors 82.

To supply fluid to the actuators 80, the engine 90 also drives a fixed displacement pump 112 from an output shaft 114 on the transmission case 94. The pump 112 draws fluid from the tank 96 through one of the supply lines 98 and delivers fluid to the actuators 80 through a delivery line 116. A pressure relief valve 118 is connected to the delivery line so that the pressure delivered to the actuators 80 is maintained constant when the swing drive assembly is in operation. The pressure relief valve 118 discharges into the sump line 108.

The engine 90, pumps 92, 112, hydraulic tank 96 and heat exchanger 109 may be mounted at any convenient location on the crane upper works 12. As shown in FIG. 2 in the illustrated embodiment an enclosed power plant housing 140 is supported by frame members 142, 144 mounted on one of the counterweight support beams 54. The engine, pumps and tank are enclosed within the housing 120 and the supply/return lines 104, 106, 110 and 116 of course extend out to the motors 82 and actuators 80.

In keeping with a further modification of the improved swing drive assembly, means are provided for applying the load resulting from the actuator force to the structure of the roller path 38 rather than transmitting this force back through the boom support 48 to the central pivot 32. To this end and as shown in FIG. 8 the roller path 38 is provided with an outer peripheral roller face 120 against which a squeeze roll 122 is engaged. The roller 122 is mounted on a lever arm 124 pivotally mounted on a bracket 126 secured to the wing 64. In this embodiment, the actuator 80a is anchored at one end on a lug 128 secured to the wing 64 and at the other end is pinned to a toggle linkage 130 interconnecting the lever arm 124 and another lug 132 secured to the motor 82. As will be apparent, when the actuator is retracted, the pinion 74 and guide roller 78 are drawn into engagement with the ring gear 72 and guide flange 78 and this force is opposed by the squeeze roller 122 engaging the roller face 120 on the outer periphery of the roller path 38.

Returning to the embodiment shown in FIG. 3, the link 73 is pinned at 132 on a bracket 134 secured to the wing 64. Referring also to FIG. 4, the actuator 80 is pinned at one end to a lug 136 on the boom support 48 and at the other end to a lug 138 on the motor 82. Preferably the link 73 is disposed substantially tangentially to the pitch line of the pinion 74 and ring gear 72 so that the driving force is imparted essentially through the axis of the pin 132 in the bracket 134. While two pinions 74 are shown in the illustrated embodiment supported by links 73 pivoted to brackets 134 on the boom support 48, it will be appreciated that additional pinions 74 and drive motors can be provided and they may be mounted on other frame elements extending outwardly from the upper works 12 to adjacent the roller path 38.

As will be appreciated by those skilled in the art, the upper works 12, particularly the boom 14 and mast 16, of the crane 10 present a considerable area against which the wind impinges. When the wind direction changes, especially during gusty periods, it creates a substantial force on the upper works 12 tending to rotate it about the lower works 28 somewhat like a hugh weather vane. In addition to starting (and reversing) inertia and friction, this wind induced rotational force is opposed by the torque generated in the motors 82 as the pinions 74 are rotated around the ring gear 72. Under these conditions, of course, it will be understood that the motors 82 actually operate as pumps and the opposing torque is dependent on the pressure generated internally in the motors and in the reversible supply/return lines 104 and 106. If flow through these lines 104, 106 is effectively blocked, for example, by the pumps 92 which are coupled through the transmission case 94 to the engine 90, tremendous back pressure builds up in the lines 104, 106 and the rotation opposing torque exerted by the pinions 74 on the ring gear is very high. This, in turn, creates large separating forces between the teeth of the pinions and ring gear and, unless relieved, can cause tooth breakage and/or uneven and rapid wear due to partial tooth separation at high loads.

Pursuant to the present invention means are provided for reducing the back pressure in lines 104, 106 and thus the wind induced torque applied to the pinions 74 when the engine 90 and pumps 92 are shut down. For this purpose, bypass valves 152 are connected to lines 104 and 106 by lines 154 and 156, respectively, to shunt the flow of hydraulic fluid around the pumps 92 when the valves 152 are open. This greatly reduces the back pressure in the lines 104 and 106 to a level dependent only upon their internal flow restrictions. Consequently, the opposing torque of the pinions 74 and the forces tending to separate them from the ring gear 72 are also significantly reduced.

When the engine 90 is shut down, the valves 152 are automatically biased to the open position. As shown in FIG. 7 a spring biased actuator 158 is provided having its piston rod end connected to the valves 152 so as to normally move them to the open position. The cylinder end of the actuator is connected by a line 160 to receive charge pressure from one of the pumps 92 when it is operated by the motor 90. Pressure in the cylinder end of the actuator 158 compresses the spring and moves the bypass valves to the closed position. This places the pumps 92 in direct communication with the motors 82 for normal swing drive operation as previously described.

In accordance with another aspect of the present invention, means are also provided for maintaining the pinions 74 in constant mesh with the ring gear 72 when the engine 90 and pumps 92 and 112 are shut down. To this end, a spring 162 is interposed between the boom support 48 and the housing 88, as shown in FIGS. 3 and 4, to bias the pinion 74 toward the ring gear 72 and the roller 78 into engagement with the guide flange 76. Preferably, the spring 162 is mounted above and parallel to the actuator 80 by means of lugs 164 and 166 on the support 48 and housing 88, respectively, although it is understood that this mounting arrangement could be modified or even reversed to suit the space available on a particular machine. It will also be appreciated that because the valves 152 are opened, when the engine 90 is shut down, the torque and the separating forces on the pinions are reduced and therefore the counteracting force required by the springs 162 is only a fraction of the force imposed by the actuators 80 during normal swing drive operation.

From the foregoing, it will be seen that the present invention provides an improved swing drive assembly for heavy duty crane assemblies rotatably supported on large diameter roller paths. By providing a hydraulic actuator 80 urging a guide roller 78 into engagement with a guide flange 76, the backlash of the pinion gear 74 can be maintained substantially constant regardless of eccentricities or other irregularities in the ring gear 72 during normal swing drive operation. Moreover, by shunting the flow of hydraulic fluid around the pumps 92, when the engine is shut down, the wind induced torque and the separating force on the swing pinions are significantly reduced. This reduced separating force may then be effectively counteracted by compression springs 162 mounted parallel to the hydraulic actuators 80.

We claim as our invention:

1. A swing drive assembly for a load handling device having upper works rotatable about a central pivot and supported by rollers on a roller path disposed substantially concentrically with said pivot, comprising, in combination, a frame element mounted on said upper works and extending outwardly therefrom to adjacent said roller path, means defining a ring gear secured to one peripheral edge of said roller path, mounting means on said frame element for journalling a pinion gear for normal engagement with said ring gear and for moving said pinion gear toward and away from said ring gear, a guide flange mounted on said roller path concentric with said ring gear, a guide roller supported by said frame element and journalled for engagement with said flange, means including a reversible hydraulic motor for driving said pinion against said ring gear so as to swing said upper works about said pivot, first actuator means including a hydraulic actuator for urging said pinion toward said ring gear and said roller into engagement with said flange so as to maintain substantially constant backlash between said pinion and ring gear regardless of eccentricities in said roller path, hydraulic pump means for selectively pressurizing said motor and for constantly pressurizing said first actuator during normal swing drive operation, and means for bypassing the flow of hydraulic fluid around said motor and second actuator means including a compression spring for urging said pinion toward said ring gear and said roller into engagement with said flange when said pump means is shut down.

2. A swing drive assembly as defined in claim 1 including reversible supply/return lines between said motor and said selectively pressurizing pump means and said bypass means includes a valve normally biased to the open position for shunting flow between said lines and a valve operator connecting to said pump means for closing said valve incident to receiving pressure from said pump means.

3. A swing drive assembly as defined in claim 1 including a plurality of arcuately spaced drive pinion and guide roller assemblies, with each assembly having first and second actuator means for urging said pinion toward said ring gear and said roller into engagement with said flange.

4. A swing drive assembly for a load handling device having upper works rotatable about a central pivot and supported by rollers on a roller path disposed substantially concentrically with said pivot, comprising, in combination, a frame element mounted on said upper works and extending outwardly therefrom to adjacent said roller path, means defining a ring gear secured to one peripheral edge of said roller path, mounting means including a link pivotally mounted on said frame element for journalling a pinion gear for normal engagement with said ring gear and for moving said pinion gear toward and away from said ring gear, a guide flange mounted on said roller path concentric with said ring gear, a guide roller supported by said link and journalled concentrically with said pinion for engagement with said flange, said link being disposed substantially tangentially to the pitch line of said pinion and ring gear, means for driving said pinion against said ring gear so as to swing said upper works about said pivot, first and second actuator means for urging said pinion toward said ring gear and said roller into engagement with said flange so as to maintain substantially constant backlash between said pinion and ring gear regardless of eccentricities in said roller path, said first actuator means including a hydraulic cylinder and a hydraulic pump for constantly pressurizing said first actuator during normal swing drive operation, and said second actuator including a compression spring for urging said pinion toward said ring gear and said roller into engagement with said flange when said pump is shut down.

5. A swing drive assembly as defined in claim 4 wherein said first and second actuator means are disposed between said link and frame element for swinging said pinion and guide roller respectively into engagement with said ring gear and guide flange.

* * * * *